US010301754B2

(12) United States Patent
Saito et al.

(10) Patent No.: US 10,301,754 B2
(45) Date of Patent: May 28, 2019

(54) SEWING MACHINE

(71) Applicant: JUKI CORPORATION, Tokyo (JP)

(72) Inventors: Masaru Saito, Tokyo (JP); Etsuo Nemoto, Tokyo (JP); Hiroyuki Tanaka, Tokyo (JP); Kimihiro Yokose, Tokyo (JP)

(73) Assignee: JUKI CORPORATION, Tokyo (JP)

( * ) Notice: Subject to any disclaimer, the term of this patent is extended or adjusted under 35 U.S.C. 154(b) by 192 days.

(21) Appl. No.: 15/404,246

(22) Filed: Jan. 12, 2017

(65) Prior Publication Data

US 2017/0204549 A1 Jul. 20, 2017

(30) Foreign Application Priority Data

Jan. 14, 2016 (JP) ..... 2016-005099

(51) Int. Cl.
*D05B 69/36* (2006.01)
*D05B 51/00* (2006.01)

(52) U.S. Cl.
CPC ..... *D05B 69/36* (2013.01); *D05B 51/00* (2013.01)

(58) Field of Classification Search
CPC ..... D05B 69/36; D05B 57/143; D05B 51/00
See application file for complete search history.

(56) References Cited

U.S. PATENT DOCUMENTS 4,284,020 A * 8/1981 Connor, Jr. ..... D05B 51/00 112/273
4,934,292 A * 6/1990 Mardix ..... D05B 51/00 112/273
4,991,528 A * 2/1991 Bellio ..... D05B 69/20 112/197
5,069,151 A * 12/1991 Bellio ..... D05B 51/00 112/278
5,140,920 A * 8/1992 Bellio ..... D05B 51/00 112/278
5,199,365 A * 4/1993 Arnold ..... D05B 51/00 112/273
5,233,936 A * 8/1993 Bellio ..... D05B 51/00 112/197

(Continued)

FOREIGN PATENT DOCUMENTS

JP 2000-197786 A 7/2000

*Primary Examiner* — Danny Worrell

(74) *Attorney, Agent, or Firm* — Drinker Biddle & Reath LLP

(57) ABSTRACT

A sewing machine includes a vertical shuttle and a middle shuttle presser disposed at a front side of the vertical shuttle. The sewing machine includes a presser frame, an optical upper thread detector and a stitch skipping detection processor. The presser frame is movably supported between a pressing position at which the middle shuttle presser is pressed and a retract position separated from the pressing position. The optical upper thread detector is provided at the presser frame and is configured to detect passage of an upper thread using detecting light which passes through passage portions formed in the middle shuttle presser and which crosses a front side of a bobbin case of the vertical shuttle. The stitch skipping detection processor is configured to determine whether the passage of the upper thread is present based on an amount of received light of the detecting light from the upper thread detector.

10 Claims, 7 Drawing Sheets

(56) References Cited

U.S. PATENT DOCUMENTS

| | | | | | |
|---|---|---|---|---|---|
| 5,383,417 | A * | 1/1995 | Norrid | D05B 51/00 | 112/278 |
| 5,404,824 | A * | 4/1995 | Hiraoka | D05B 49/04 | 112/254 |
| 5,606,926 | A * | 3/1997 | Schroeder, Jr. | D05B 19/12 | 112/273 |
| 5,842,431 | A * | 12/1998 | Wu | D05B 57/20 | 112/232 |
| 7,536,963 | B2 * | 5/2009 | Durville | D05B 51/00 | 112/254 |
| 8,020,503 | B2 * | 9/2011 | Ekholm | D05B 19/16 | 112/475.08 |
| 8,635,964 | B2 * | 1/2014 | Kinoshita | D05B 69/36 | 112/273 |
| 2011/0114000 | A1 * | 5/2011 | Kinoshita | D05B 47/06 | 112/154 |
| 2017/0204549 | A1 * | 7/2017 | Saito | D05B 51/00 | |

* cited by examiner

SEWING MACHINE

CROSS-REFERENCE TO RELATED APPLICATIONS

This application is based upon and claims the benefit of priority from Japanese Patent Application No. 2016-005099, filed on Jan. 14, 2016; the entire contents of which are incorporated herein by reference.

BACKGROUND OF INVENTION

Field of the Invention

The present invention relates to stitch skipping detection of a sewing machine which optically detects whether an upper thread, which is picked up from an upper thread loop formed by a sewing needle by a shuttle point of a shuttle, passes through the shuttle, and thereby stitch skipping by which no stitch is formed is detected.

Related Art

Needlework of a sewing machine is done as an upper thread and a lower thread form stitches as required. To be more specific, a sewing needle, through whose eye the upper thread passes, passes through fabric to protrude below the fabric, and then moves upward. When the sewing needle reaching a bottom dead point moves upward, the upper thread below the fabric is loosened, and a loop is formed. Simultaneously, a shuttle rotated in tandem with upward/downward movement of the sewing needle picks up the looped upper thread with a shuttle point at a position at which the sewing needle slightly rises from the bottom dead point. As a thread take-up lever rises at a position at which the shuttle is rotated and the shuttle point passes a given position, the shuttle is made to pass through the loop of the upper thread, and the lower thread coming out of a bobbin case to reach the fabric is entangled with the upper thread, and to form one stitch.

The conventional sewing machine detects whether the loop cuts across the bobbin case when the shuttle is made to pass through the loop of the upper thread caught by the shuttle, projects light to a front side of the bobbin case from a direction inclined with respect to a rotation center line of the shuttle, optically detects a change in light intensity of reflected light by means of a photoelectric detector, and detects generation of stitch skipping by which a knot of the upper thread and the lower thread is not formed (for example, see JP-A-2000-197786).

However, in the conventional sewing machine, the light is projected in the front of the bobbin case. However, since the bobbin case is made of a metal and generally has luster, a state of the reflected light is greatly changed by slight vibration or rattle during needlework. The influence of disturbance is increased, and it is difficult to detect passage of the thread with high accuracy.

An object of the present invention is to detect stitch skipping with higher accuracy.

SUMMARY (1) A sewing machine includes a vertical shuttle and a middle shuttle presser. The middle shuttle is disposed at a front side of the vertical shuttle. The sewing machine includes a presser frame, an optical upper thread detector and a stitch skipping detection processor. The presser frame is movably supported between a pressing position at which the middle shuttle presser is pressed and a retract position separated from the pressing position. The optical upper thread detector is provided at the presser frame and is configured to detect passage of an upper thread using detecting light which passes through passage portions formed in the middle shuttle presser and which crosses a front side of a bobbin case of the vertical shuttle. The stitch skipping detection processor is configured to determine whether the passage of the upper thread is present based on an amount of received light of the detecting light from the upper thread detector.

(2) In the sewing machine according to (1), an uneven structure for positioning is provided between the presser frame and the middle shuttle presser.

(3) In the sewing machine according to (2), the uneven structure includes a pin and a hole which allows the pin to insert in the hole.

(4) In the sewing machine according to any one of (1) to (3), the middle shuttle presser has a circumferential wall portion surrounding a periphery of the vertical shuttle. Through-holes are formed in the circumferential wall portion acting as the passage portions. A part of each through-hole has a shape configured to fit a recess shape of a concave portion formed in a front of the vertical shuttle.

(5) The sewing machine according to any one of (1) to (4), further includes a toggle mechanism. The toggle mechanism is configured to apply a pressing pressure to the presser frame at the pressing position toward the middle shuttle presser. The presser frame is rotated to move between the pressing position and the retract position.

(6) In the sewing machine according to (5), the toggle mechanism includes an input lever and an operation detector. The input lever is configured to apply and release the pressing pressure to and from the presser frame. The operation detector is configured to detect an operation state of the input lever.

(7) The sewing machine according to any one of (1) to (6), further includes an air discharge mechanism. The air discharge mechanism is configured to blow air for removing dust on a passing path of the detecting light.

(8) In the sewing machine according to (7), the air discharge mechanism is provided at the presser frame, and has nozzles which blow air on the passage portions of the middle shuttle presser from one end portion and the other end portion of the middle shuttle presser in a passing direction.

(9) In the sewing machine according to (7) or (8), the air discharge mechanism is provided at the presser frame, and has nozzles which blow air on light-receiving and light-emitting portions of the upper thread detector.

(10) The sewing machine according to any one of (7) to (9), further includes a cleaning control unit. The cleaning control unit is configured to control the air discharge mechanism to periodically blow air at intervals of a predetermined number of stitching or at a predetermined timing.

The present invention is provided with an optical upper thread detector that is equipped for a presser frame pressing a middle shuttle presser and detects passage of an upper thread by means of detecting light that passes through passage portions formed in the middle shuttle presser and crosses a front side of a bobbin case of a vertical shuttle, and a stitch skipping detection processor that determines whether passage of the upper thread is present based on an amount of received light of the detecting light caused by the upper thread detector.

For this reason, the upper thread can be detected by the detecting light crossing the front side of the bobbin case through the passage portions formed in the middle shuttle presser. Since the detecting light is not projected to the front of the bobbin case, a variation in the detecting light caused by vibration can be inhibited. Since the influence of disturbance can be reduced, the passage of the upper thread can be accurately detected, and the generation of stitch skipping can also be accurately detected.

DETAILED DESCRIPTION

[Overall Configuration of Sewing Machine]

Figure 1:
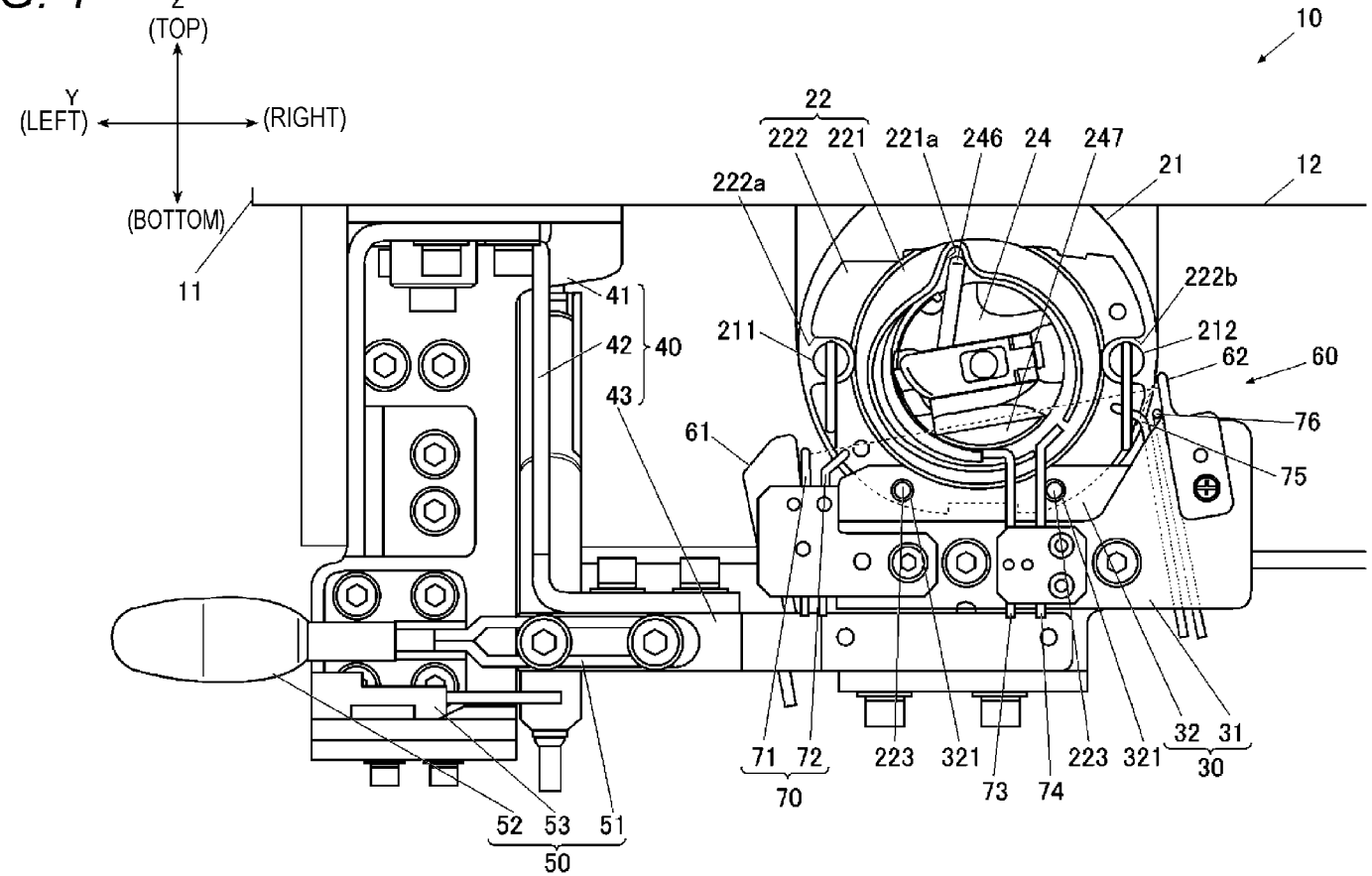
FIG. 1 is a front view around a shuttle of a sewing machine according to an embodiment of the present invention.
Figure 2:
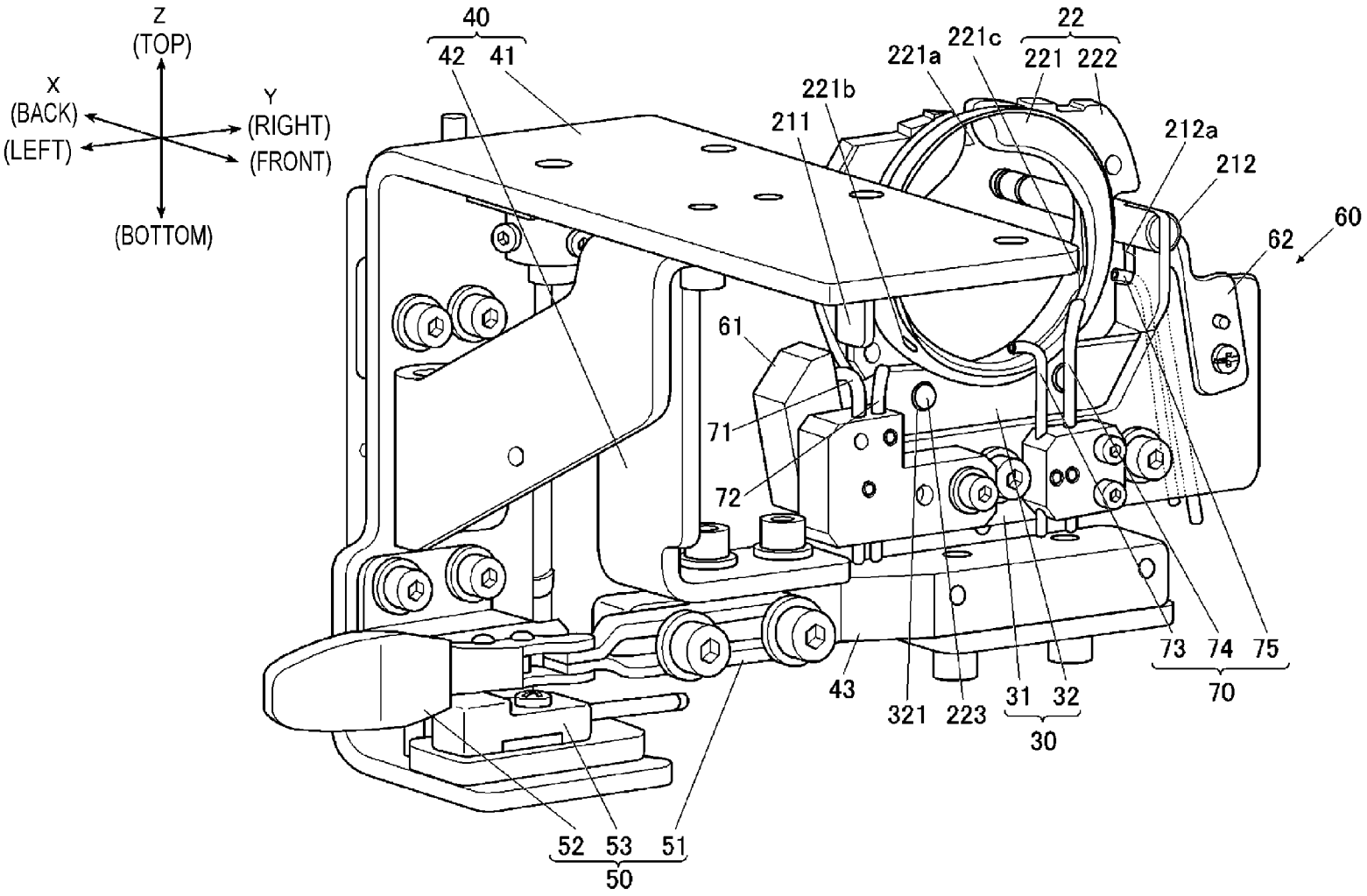
FIG. 2 is a perspective view around the shuttle of the sewing machine according to the embodiment of the present invention.

Hereinafter, a sewing machine 10 according to an embodiment of the present invention will be described in detail using the drawings. FIG. 1 is a front view around a shuttle of the sewing machine 10, and illustrates a configuration of a lower portion of a tabular needle plate auxiliary cover 11 that is disposed around a needle plate on the same plane as the needle plate. FIG. 2 is a perspective view of the same configuration.

As illustrated in FIG. 1, the sewing machine 10 is provided with a sewing machine frame that is a case. A sewing machine bed part 12 is located below the sewing machine frame. A large shuttle 21 of a vertical half-turn shuttle 20 is provided at one end of the sewing machine bed part 12 in a horizontal direction in a projected state.

In the following description, a direction that is horizontal and is parallel to a direction in which the large shuttle 21 in the sewing machine bed part 12 protrudes is defined as an X-axial direction. The large shuttle 21 side (the front side of the sheet of FIG. 1) is defined as "front," and a direction opposite to this is defined as "rear."

Further, a direction that is horizontal and is perpendicular to the X-axial direction is defined as a Y-axial direction. One end side (the left side of FIG. 1) thereof is defined as "left," and the other end side (the right side of FIG. 1) thereof is defined as "right."

Furthermore, a direction that is perpendicular to the X-axial and Y-axial directions is defined as a Z-axial direction. One end side (the upper side of FIG. 1) thereof is defined as "top," and the other end side (the lower side of FIG. 1) thereof is defined as "bottom."

The sewing machine 10 is provided with a sewing machine motor 14 with which a typical sewing machine is provided, an upper shaft, a needle bar upward/downward movement mechanism, a feed mechanism of a workpiece, a thread take-up lever, a thread tensioner, a thread cutting device, and so on. These are identical to well-known components, and thus illustration and description thereof will be omitted.

This sewing machine 10 is provided with, as characteristic configurations, a presser frame 30 that presses a middle shuttle presser 22 disposed at a front side of the vertical half-turn shuttle 20 from the front, a frame support mechanism 40 that supports the presser frame 30, an upper thread detector 60 that detects an upper thread crossing a bobbin case 24 of the vertical half-turn shuttle 20, an air discharge mechanism 70 that performs blowing of air for removing dust around the vertical half-turn shuttle 20, and a control unit 90 that controls an operation of each part of the sewing machine 10.

The front side of the vertical half-turn shuttle 20 is referred to as a surface on which the bobbin case 24 is disposed with respect to a middle shuttle 23 to be described below.

[Vertical Half-Turn Shuttle]

The vertical half-turn shuttle 20 is provided with the large shuttle 21 having an approximately cylindrical shape, a middle shuttle 23 that is rotatably supported inside the large shuttle 21, the bobbin case 24 that is housed inside the middle shuttle 23, a bobbin (not illustrated) that is housed in the bobbin case 24, and a middle shuttle presser 22 that holds the middle shuttle 23 housed in the large shuttle 21.

The large shuttle 21 is in an approximately cylindrical shape, and is fixedly supported by a front end of the sewing machine bed part 12 in a state in which a center line thereof is parallel to the X-axial direction.

A middle portion of a front end of the large shuttle 21 is widely open in a circular shape, and the middle shuttle 23 is housed inside the large shuttle 21. A slidable contact portion is formed inside the large shuttle 21 along a circumference around an X axis, is in sliable contact with an outer circumference of the middle shuttle 23, and supports the middle shuttle 23 to be rotatable around the X axis.

The middle shuttle 23 is provided with a spindle inserted into the bobbin and the bobbin case 24 at an internal center position of rotation thereof, and a shuttle point for catching the upper thread at an outer circumference thereof.

A driver (not illustrated), to which reciprocating rotation motion centered on the X axis is given by a sewing machine motor acting as a driving source of the needlework, is provided along with this middle shuttle 23. The middle shuttle 23 performs the reciprocating rotation motion centered on the X axis along with the driver. Due to this reciprocating rotation motion, the middle shuttle 23 catches the loop of the upper thread from the sewing needle when the shuttle point is located at an uppermost position, and is rotated downward to pull out the loop of the upper thread. After the loop of the upper thread is made to pass through a lowermost portion of the middle shuttle 23, the middle shuttle 23 can be changed to reverse rotation, and return the shuttle point to an uppermost portion thereof. Since the loop of the upper thread pulled out up to a position at which it is made to pass through the lowermost portion of the middle shuttle 23 is raised upward by raising of a thread take-up lever, the loop of the upper thread is raised upward despite being separated from the shuttle point, and a knot can be formed by the upper thread and the lower thread.

[Vertical Half-Turn Shuttle: Bobbin Case]

Figure 3A:
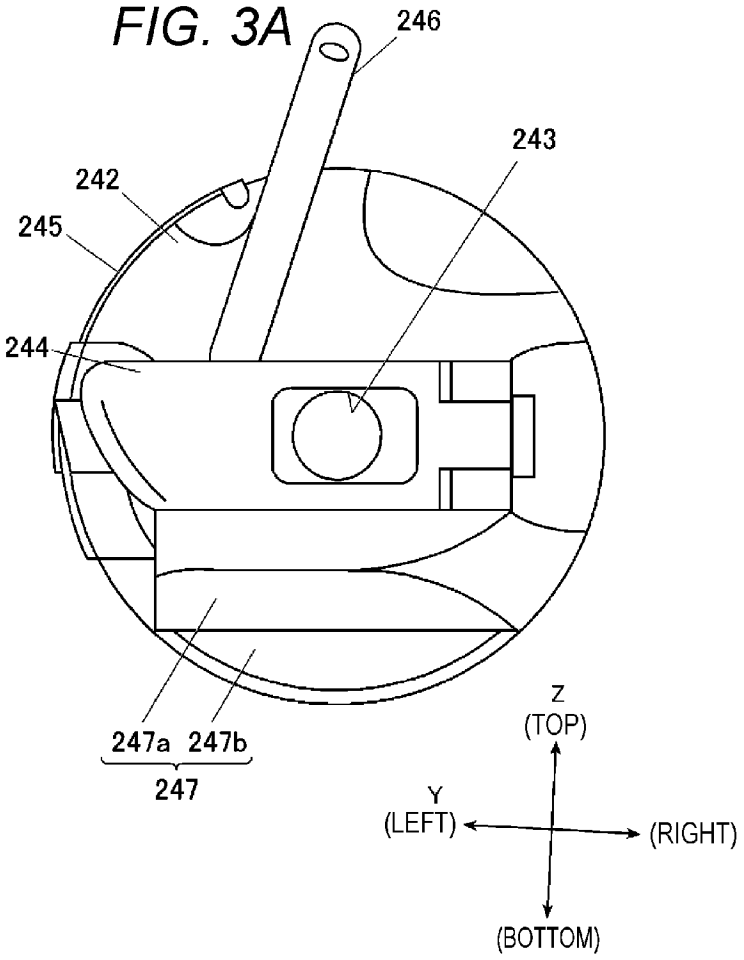
FIG. 3A is a front view of a bobbin case and FIG. 3B is a side view of the bobbin case.
Figure 3B:
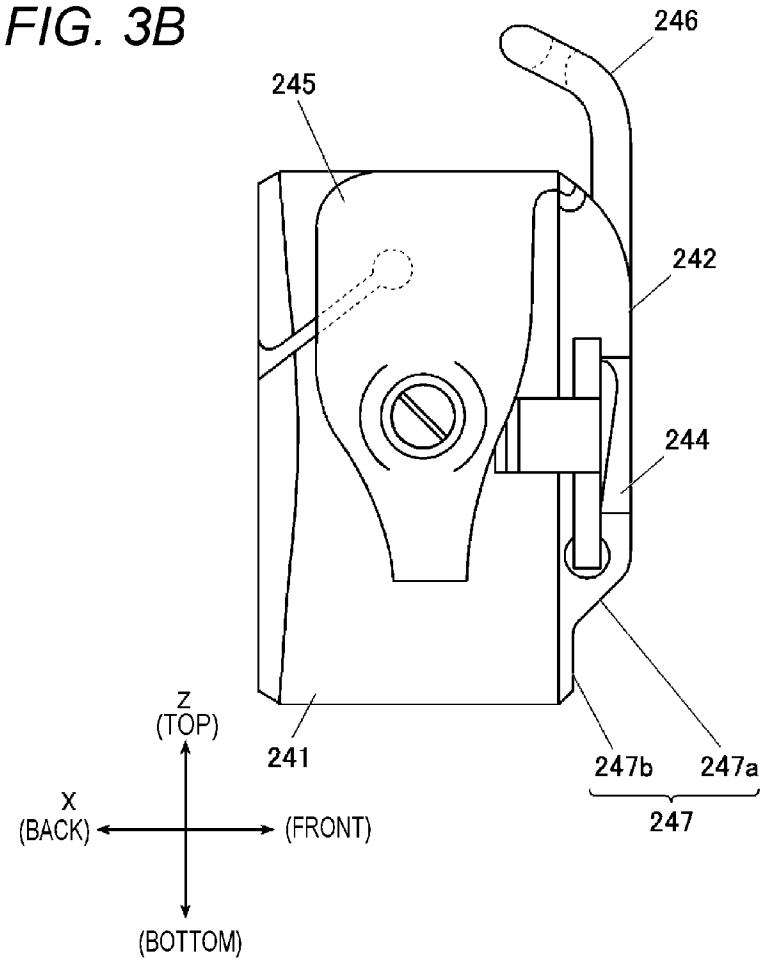

FIG. 3A is a front view of the bobbin case 24, and FIG. 3B is a side view of the bobbin case 24. As illustrated, the bobbin case 24 is provided with a cylindrical outer circumference portion 241 in which the bobbin is housed, and a front portion 242 that blocks a front end of the outer circumference portion 241. The bobbin case 24 is provided with a circular hole portion 243 into which the spindle of the middle shuttle 23 is inserted at the center of the front portion 242, a locking lever 244 that locks a circumferential groove formed at a tip of the inserted spindle of the middle shuttle 23 and prevents falling off, a thread tension spring 245 for giving a tensile force to the lower thread fed out from the internal bobbin, an angle portion 246 that extends upward from the front portion 242 and includes inside an upper end of which an insertion hole of the lower thread is formed, and a concave portion 247 that is formed at a lower portion of the front portion 242 and is recessed backward.

The outer circumference portion 241 is widely open at a rear end side thereof, and the bobbin can be inserted thereinto from there.

In addition, the outer circumference portion 241 is provided with a feed opening of the lower thread, and can feed the wound lower thread of the internal bobbin to the outside.

The thread tension spring 245 is a leaf spring bent to follow a circumferential surface of the outer circumference portion 241, and is attached outside the outer circumference portion 241 to cover the thread feed opening. As the lower thread passes a clearance between the outer circumference portion 241 and the thread tension spring 245, a tensile force caused by sliding friction can be given.

As described above, the circular hole portion 243 is formed at the center of the front portion 242, and is equipped with the locking lever 244 in such a way as to cross the circular hole portion 243. This locking lever 244 can be rotated to rise and fall with respect to the front portion, and locks the tip of the spindle of the middle shuttle 23 by means of a rectangular opening formed at a position corresponding to the circular hole portion 243.

The angle portion 246 extends toward diagonally upward right from an upper side of the locking lever 244 at the front portion 242. This angle portion 246 is bent backward at an upper end thereof, and has an insertion hole formed in a tip thereof. The lower thread fed out from the bobbin is guided to a needle hole of the needle plate through the insertion hole of the angle portion 246 via the thread tension spring 245.

In FIG. 3A, in a state in which the upper end of the angle portion 246 is located just above the center of the front portion 242, the bobbin case 24 is illustrated. However, as illustrated in FIG. 1, the bobbin case 24 is housed in the middle shuttle 23 in a state in which it is somewhat inclined leftward.

The concave portion 247 formed at a lower portion of the front portion 242 has an oblique surface 247*a* that is inclined backward from the front portion 242, and a retreat surface 247*b* that is parallel to the front portion 242 and is located behind the front portion 242.

In FIG. 3A, both the oblique surface 247*a* and the retreat surface 247*b* are illustrated to be long in a horizontal direction. However, as illustrated in FIG. 1, in the state in which the bobbin case 24 is housed in the middle shuttle 23, the oblique surface 247*a* and the retreat surface 247*b* are kept inclined leftward to some degree. A boundary between these two planes forms a valley in a direction inclined downward to the left.

Forming this concave portion 247 at the lower portion of the front portion 242 is for reducing sliding resistance of the upper thread passing the lower portion of the front portion 242 when the bobbin case 24 is made to pass through the loop of the upper thread which the aforementioned shuttle point of the middle shuttle 23 catches.

Like an upper portion of the front portion 242, when a curved surface gently curved backward is also formed at the lower portion of the front portion 242, the upper thread moves while sliding in contact with the entire curved surface, and the sliding resistance is increased.

In contrast, when the concave portion 247 is formed, since an upper edge of the oblique surface 247*a* and a lower edge of the retreat surface 247*b* merely slide in contact with the upper thread, the sliding resistance can be reduced due to a reduction in contact area.

Therefore, the bobbin case 24 can be favorably made to pass through the loop of the upper thread, stitches can be stably formed.

[Vertical Half-Turn Shuttle: Middle Shuttle Presser]

The middle shuttle presser 22 is provided with a circumferential wall portion 221 that has an approximately ring shape and surrounds a circumference of the middle shuttle 23, and a flange portion 222 that extends around from an outer circumference of the circumferential wall portion 221 except an upper portion of the circumferential wall portion 221.

The circumferential wall portion 221 passes forward and backward in a state in which it is widely open in an approximately circular shape, and is provided with a slidable contact surface that slides in contact with a front surface of an outer edge of the middle shuttle 23 on the inside thereof.

Since the circumferential wall portion 221 is widely open, the bobbin case 24 can be put in and out from an opening with the middle shuttle presser 22 attached to the large shuttle 21.

Further, a fitting concave portion 221*a* recessed outward is formed at a front inner circumferential portion of the circumferential wall portion 221, and the angle portion 246 of the bobbin case 24 is fitted into the fitting concave portion 221*a*. As the angle portion 246 is fitted into this fitting concave portion 221*a*, rotation associated with the middle shuttle 23 around the bobbin case 24 is impeded, and the bobbin case 24 can maintain a resting state.

The flange portion 222 of the middle shuttle presser 22 is formed with cutouts 222*a* and 222*b* recessed left and right in a U shape. Attachment members 211 and 212 equipped with the front portion of the large shuttle 21 are disposed inside the cutouts 222*a* and 222*b*.

Each of the left and right attachment members 211 and 212 is provided with a shaft part running in the X-axial direction, and a tabular handling lever provided at a front end of the shaft part. The shaft part is inserted into an attachment hole (not illustrated) formed in the front of the large shuttle 21, and is made rotatable and undetachable.

The handling lever extends from the front end of the shaft part in a radial direction centered on the shaft part. The handling lever can be handled to be rotated by a hand of a person.

The attachment members 211 and 212 do not interfere with the flange portion 222 of the middle shuttle presser 22 in a state in which the respective handling levers are mutually directed outward, and can attach and detach the middle shuttle presser 23 to and from the large shuttle 21. In the event of the attachment, the middle shuttle presser 22 is disposed in the front of the large shuttle 21 by positioning the cutouts 222*a* and 222*b* with respect to the attachment members 211 and 212, and the handling lever of each of the attachment members 211 and 212 is turned downward. Thereby, the handling lever is brought into contact with the front of the flange portion 222 of the middle shuttle presser 22, and is held such that the middle shuttle presser 22 is not detached forward from the large shuttle 21.

Since the handling lever of the right attachment member 212 is disposed to shield a light path for detecting light of an optical element of the upper thread detector 60 (to be described below), a part thereof becomes an opening 212*a* cut out in a rectangular shape, and the detecting light can pass through the opening 212*a*.

Figure 4A:
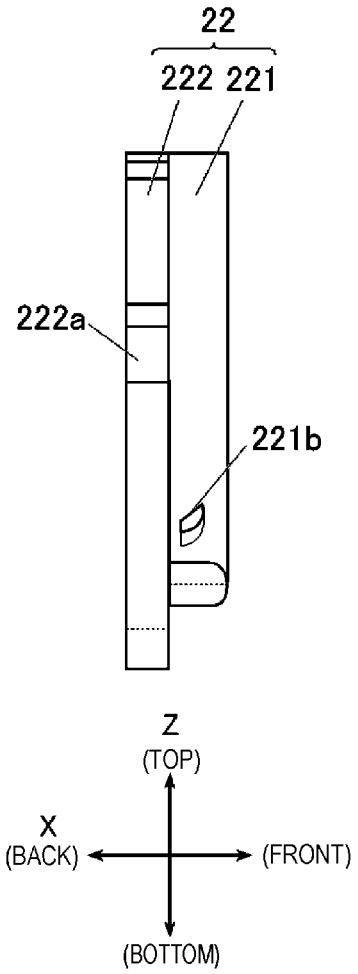
FIG. 4A is a left side view of a middle shuttle presser and FIG. 4B is a right side view of the middle shuttle presser.
Figure 4B:
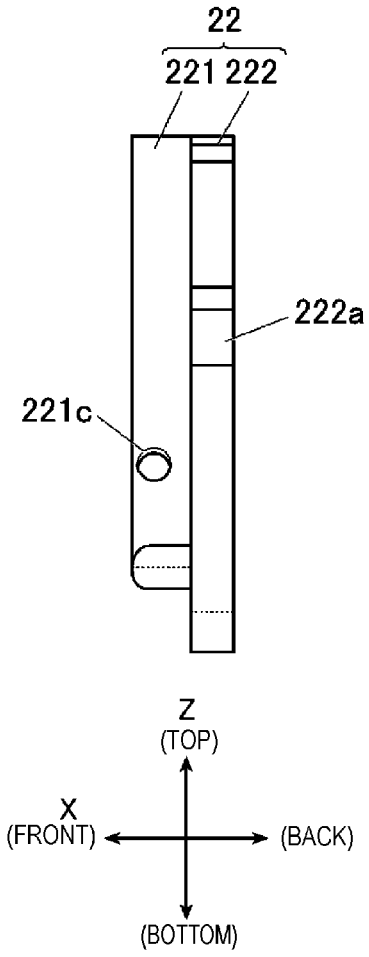

Since the circumferential wall portion 221 of the middle shuttle presser 22 is also disposed to shield the light path for the detecting light of the optical element of the upper thread detector 60 (to be described below), through-holes 221*b* and 221*c* acting as passage portions passed along the light path are formed in left and right lower portions of the circumferential wall portion 221 as illustrated in FIGS. 4A and 4B.

The upper thread detector 60 (to be described below) is provided with an optical unit 61 acting as a light receiving portion and a light emitting portion that receive and project the detecting light from a left lower side of the middle shuttle presser 22 in a diagonally upward direction, and a reflector 62 that reflects the detecting light at a right lower side of the middle shuttle presser 22. The detecting light is configured to be parallel to a longitudinal direction of the concave portion 247 of the aforementioned bobbin case 24 and to pass through the inside of the concave portion 247.

That is, like the concave portion 247, since the light path of the detecting light takes a direction somewhat inclined downward to the left with respect to the Y-axial direction, the left through-hole 221*b* is formed at a position that is somewhat lower than the right through-hole 221*c*.

As described above, since the upper thread detector 60 has the optical unit 61 and the reflector 62 disposed such that the detecting light passes through the concave portion 247 of the bobbin case 24 passes therethrough, when the bobbin case is made to pass through the loop of the upper thread, the upper thread moves along the upper edge of the oblique surface 247*a* and the lower edge of the retreat surface 247*b* so as not to come into contact with the concave portion 247, and part of the detecting light is shielded to generate a reduction in an amount of received light, so that the upper thread detector 60 can detect that the upper thread does not generate the stitch skipping and the stitches are formed.

Therefore, in the through-hole 221*b* of the optical unit 61 side that receives the detecting light, it is undesirable that a variation in the amount of received light of the detecting light occurs due to causes other than the upper thread.

On the other hand, as illustrated in FIG. 4A, the through-hole 221*b* of the optical unit 61 side is formed in an approximately fan shape without a shape thereof being a circular shape like the through-hole 221*c* of the reflector 62 side, and thereby an influence of the variation in the amount of received light of the detecting light is reduced.

That is, since the middle shuttle 23 is reciprocated and rotated around the bobbin case 24 at a high speed, particularly vibration in a forward/backward direction easily occurs. A cross-section shape of the concave portion 247 through which the detecting light passes and which is taken along an X-Z plane is decided by the oblique surface 247*a* and the retreat surface 247*b*.

When the detecting light passing through this concave portion 247 is received, if the shape of the through-hole 221*b* of the optical unit 61 side is set to an approximately circular shape like the through-hole 221*c* of FIG. 4B, a shielding region caused by the oblique surface 247*a* and the retreat surface 247*b* is generated within a range of the approximately circular shape. When the bobbin case 24 vibrates forward and backward, the shielding region also vibrates. For this reason, the variation in the amount of received light of the detecting light occurs, and detecting accuracy of the upper thread is reduced.

Figure 5:
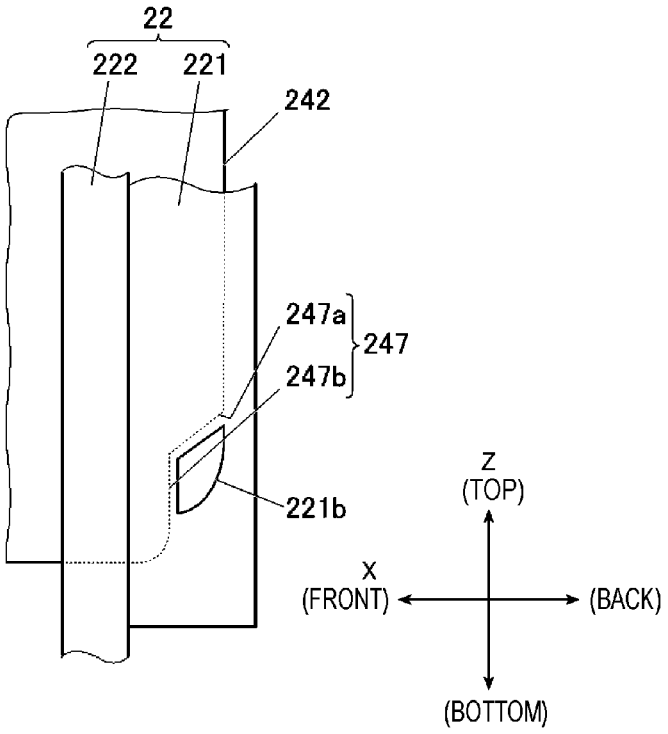
FIG. 5 is a partially enlarged view of a left side of the middle shuttle presser.

For this reason, as illustrated in FIG. 5, the through-hole 221*b* of the optical unit 61 side is formed in the approximately fan shape, and an amount of generation of the shielding region caused by the oblique surface 247*a* and the retreat surface 247*b* is reduced or excluded. Thereby, the variation in the amount of received light of the detecting light due to the vibration of the bobbin case 24 is reduced, the detecting accuracy of the upper thread is improved.

If the shape of the through-hole 221*b* of the optical unit 61 side is a shape that is not shielded by the oblique surface 247*a* and the retreat surface 247*b* of the concave portion 247, it may be shapes other than the approximately fan shape, for example, a rhombic shape, a parallelogram, a groove shape in which the through-hole is open, and so on.

Two pins 223 and 223 that are used for positioning and protrude forward in a circular protrusion shape are formed at a front lower portion of the flange portion 222 of the middle shuttle presser 22. These pins 223 and 223 constitute a part of an uneven structure that is intended to perform positioning and is formed between the presser frame 30 (to be described below) and the middle shuttle presser 22, are inserted into two positioning holes 321 and 321 of the presser frame 30 side constituting the uneven structure, and relatively position the middle shuttle presser 22 and the presser frame 30 at proper positions.

[Presser Frame]

The presser frame 30 is a frame that is supported by the frame support mechanism 40 (to be described below) to be movable between a pressing position (see FIG. 6) at which the middle shuttle presser 22 is pressed backward from the front and a retract position (see FIG. 7) spaced apart from the pressing position.

In the following description, unless particularly mentioned, an orientation or direction and a position of each configuration shall indicate those when the presser frame 30 is situated at the pressing position.

This presser frame 30 is provided with a tabular main body 31 that runs along a Y-Z plane at the pressing position, and a tabular support plate 32 that is fixed to a rear side of the main body 31 and runs along the Y-Z plane along with the main body.

The support plate 32 is held to be connected to the frame support mechanism 40 at a lower end thereof. An arc-like concave portion that is in contact with a lower end of the outer circumference of the circumferential wall portion 221 of the middle shuttle presser 22 is formed at an upper end of the support plate 32. The two positioning holes 321 and 321 are formed below the arc-like concave portion of the support plate 32 in a passing way in the X-axial direction.

As described above, these positioning holes 321 and 321 constitute a part of the uneven structure that is intended to perform positioning and is formed between the presser frame 30 and the middle shuttle presser 22, are fitted around the pins 223 and 223 of the middle shuttle presser 22, and relatively position the middle shuttle presser 22 and the presser frame 30 at proper positions.

The main body 31 is fixed to a front side of the support plate 32, and is subjected to position switching in one body with the support plate 32 by the frame support mechanism 40.

The main body 31 fixedly supports the optical unit 61 of the upper thread detector 60 at a rear lateral portion thereof, and the reflector 62 at a front right end thereof.

The main body 31 fixedly supports first and second nozzles 71 and 72 of the air discharge mechanism 70 at a front left end thereof, third and fourth nozzles 73 and 74 at a front center portion thereof, and fifth and sixth nozzles 75 and 76 at a rear right end thereof.

[Upper Thread Detector]

As described above, the upper thread detector 60 is provided with the optical unit 61 that is fixedly supported at a rear left end of the main body 31 of the presser frame 30, and the reflector 62 that is fixedly supported at the front right end of the main body 31.

The optical unit 61 is provided with the light-emitting element that projects the detecting light toward the reflector 62, and the light-receiving element that receives the detecting light reflected by the reflector 62. The light-emitting element and the light-receiving element are disposed to be adjacent to each other, and are directed to the reflector 62 side at which a light-projecting direction of the light-emitting element and a light-receiving direction of the light-receiving element are the same direction. That is, the light-emitting element and the light-receiving element are parallel to the longitudinal directions of the oblique surface 247*a* and the retreat surface 247*b* of the concave portion 247 of the bobbin case 24, and set the inside of the concave portion 247 to a direction in which the detecting light passes.

The reflector 62 has a reflecting surface extending backward, and the reflecting surface is situated on an optical axis of the detecting light and has a direction perpendicular to the optical axis.

With the above configuration of the upper thread detector 60, when the detecting light is projected from the light-emitting element of the optical unit 61, the detecting light passes through the through-hole 221*b* of the middle shuttle presser 22, passes through the through-hole 221*c* of the middle shuttle presser 22 past the concave portion 247 of the bobbin case 24 provided inside the middle shuttle presser 22, is reflected by the reflecting surface of the reflector 62 in a parallel and reverse direction, passes through the through-hole 221*c*, the concave portion 247, and the through-hole 221*b* again, and is received by the light-receiving element of the optical unit 61.

During needlework, the optical unit 61 detects that the loop of the upper thread passes through the concave portion 247 and that the amount of received light of the detecting light is reduced at a given angle of an upper shaft, and thereby formation of a proper knot is detected. When the optical unit 61 does not detect that the amount of received light of the detecting light is reduced at the given angle of the upper shaft, and thereby generation of stitch skipping is detected.

[Frame Support Mechanism]

Figure 6:
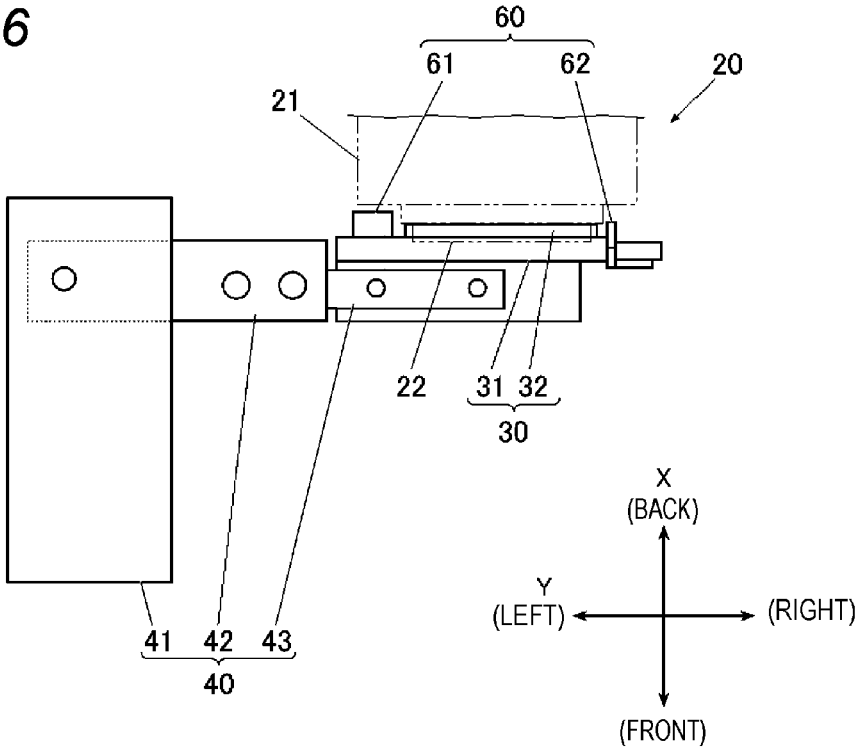
FIG. 6 is a plan view of a frame support mechanism when a presser frame is situated at a pressing position.
Figure 7:
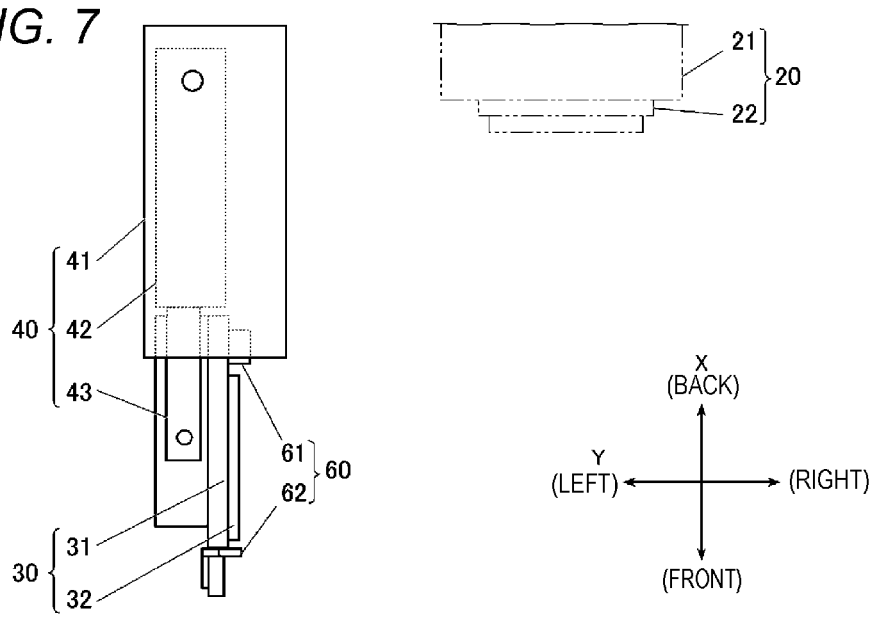
FIG. 7 is a plan view of the frame support mechanism when the presser frame is situated at a retract position.

FIG. 6 is a plan view illustrating a state in which the frame support mechanism 40 supports the presser frame 30 at a pressing position, and FIG. 7 is a plan view illustrating a state in which the frame support mechanism 40 supports the presser frame 30 at a retract position.

As illustrated in FIGS. 1, 2, 6 and 7, the frame support mechanism 40 is provided with a base frame 41 that is fixedly supported by the needle plate auxiliary cover 11 and the sewing machine bed part 12, a rotary plate 42 that is supported by the base frame 41 to be rotatable around a Z axis, a support block 43 that is fixed to a rotational end of the rotary plate 42 and supports the presser frame 30, and a toggle mechanism 50 that presses the presser frame 30 situated at a pressing position to the large shuttle 21 side via the support block 43.

The base frame 41 is an approximate U-shaped frame when viewed from the Y-axial direction, and an upright plate portion running along the Y-Z plane, a top plate portion extending forward from an upper end of the upright plate portion, and a bottom plate portion extending forward from a lower end of the upright plate portion are formed by bending a long flat plate.

The upright plate portion of the base frame 41 is fixed to the front of the sewing machine bed part 12 by screwing, and the top plate portion is fixed to a bottom surface of the needle plate auxiliary cover 11 by screwing.

As illustrated in FIGS. 6 and 7, the rotary plate 42 is rotated around the Z axis within an angle of about 90°, holds the presser frame 30 at a pressing position in a state in which a rotational end thereof is directed to the right, and holds the presser frame 30 at a retract position in a state in which the rotational end thereof is directed to the front.

When situated at the pressing position, this rotary plate 42 has a crank shape when viewed from the X-axial direction, and an upright plate portion running along the X-Z plane, a top plate portion extending leftward from an upper end of the upright plate portion, and a bottom plate portion extending rightward from a lower end of the upright plate portion are formed by bending a long flat plate.

The top plate portion of the rotary plate 42 is rotatably supported with respect to the top plate portion of the base frame 41 by a spindle running in the Z-axial direction, and the support block 43 is screwed and fixed to a bottom surface of the bottom plate portion of the rotary plate 42.

The support block 43 is a long block running in the Y-axial direction. A top surface of a left end of the support block 43 is fixed to the bottom surface of the bottom plate portion of the rotary plate 42 by screwing, and a bottom portion of the support plate 32 of the presser frame 30 is fixedly supported on a bottom surface of a right end of the support block 43 by screwing.

[Frame Support Mechanism: Toggle Mechanism]

The toggle mechanism 50 is provided with a link body 51, one end of which is coupled to the support block 43 and the other end of which is supported by the bottom plate portion of the base frame 41 to be rotatable around the Z axis, an input lever 52 that operates application and release of a pressing pressure to and from the presser frame 30, and an operation detector 53 that detects an operation state of the input lever 52.

The link body 51 is supported on the bottom plate portion of the base frame 41 by a spindle that is situated on the same axis as the spindle of the rotary plate 42 to be rotatable around the Z axis. Therefore, the link body 51, the rotary plate 42, the support block 43, and the presser frame 30 can be rotated around the Z axis as one body.

The input lever 52 is supported at the left side of the link body 51 by the bottom plate portion of the base frame 41 to be rotatable around the Z axis, and a connecting arm between the link body 51 and an operation portion inputting rotational operation with a human hand extends to one side and the other side across a rotating spindle of the input lever 52.

The connecting arm of the input lever 52 is connected to the link body 51 to be rotatable around the Z axis in the vicinity of a rotating spindle thereof.

When the input lever 52 is rotated in a clockwise direction when viewed from above, counterclockwise rotation is given to the link body 51, and the presser frame 30 can be rotated from the retract position toward the pressing position.

Further, a mutual connecting position is designed between the input lever 52 and the link body 51 to become a dead point in front of the pressing position. When the mutual connecting position approaches the dead point, elastic flexure is generated between the members of the input lever 52 and the link body 51. Until the mutual connecting position exceeds the dead point, elastic forces of the input lever 52 and the link body 51 act in a rotating direction toward the retract position. When the mutual connecting position exceeds the dead point, an elastic force caused by flexure of the input lever 52 and the link body 51 is changed to a rotating direction toward the pressing position.

Thereby, the toggle mechanism 50 can give a pressing pressure toward the middle shuttle presser 22 side to the presser frame 30 situated at the pressing position via the link body 51 and the support block 43.

When the presser frame 30 is rotated toward the middle shuttle presser 22 side by the toggle mechanism 50 via the link body 51 and the support block 43, the two positioning holes 321 and 321 of the presser frame 30 coincide in position with the pins 223 and 223 of the middle shuttle presser 22, and the members are assembled such that the pins 223 and 223 are inserted into the positioning holes 321 and 321.

In addition, tips of the pins 223 and 223 have tapered shapes or round shapes. Even if slight position deviation occurs, the pins 223 and 223 are configured to be guided into the positioning holes 321 and 321.

The operation detector 53 is a proximity sensor, and is disposed to be closest to a position of the input lever 52 when the presser frame 30 is moved up to the pressing position. Thereby, the operation detector 53 can detect from the approach of the input lever 52 that the presser frame 30 is situated at the pressing position.

[Air Discharge Mechanism]

The air discharge mechanism 70 is provided with an air pressure generator (not illustrated) using a pneumatic pump or the like, and first to sixth nozzles 71 to 76 that are connected to the air pressure generator via an electromagnetic valve and discharge air.

All the first to sixth nozzles 71 to 76 are supported by the main body 31 of the presser frame 30. Each of the nozzles performs blowing of air on a given position in the state in which the presser frame 30 is situated at the pressing position, and removing dust.

The first nozzle 71 is supported toward the light-emitting and light-receiving elements of the optical unit 61 of the upper thread detector 60 at a tip thereof, and removes dust sticking to the optical unit 61.

The second nozzle 72 is supported from the outside of the circumferential wall portion 221 of the middle shuttle presser 22 toward the through-hole 221*b* at a tip thereof, and removes dust sticking to the periphery of the through-hole 221*b* on the outer circumferential surface of the circumferential wall portion 221 and to the inside of the through-hole 221*b*.

The third nozzle 73 is supported from the inside of the circumferential wall portion 221 of the middle shuttle presser 22 toward the through-hole 221*b* at a tip thereof, and removes dust sticking to the periphery of the through-hole 221*b* on the inner circumferential surface of the circumferential wall portion 221 and to the inside of the through-hole 221*b*.

The fourth nozzle 74 is supported from the inside of the circumferential wall portion 221 of the middle shuttle presser 22 toward the through-hole 221*c* at a tip thereof, and removes dust sticking to the periphery of the through-hole 221*c* on the inner circumferential surface of the circumferential wall portion 221 and to the inside of the through-hole 221*c*.

The fifth nozzle 75 is supported from the outside of the circumferential wall portion 221 of the middle shuttle presser 22 toward the through-hole 221*c* at a tip thereof, and removes dust sticking to the periphery of the through-hole 221*c* on the outer circumferential surface of the circumferential wall portion 221 and to the inside of the through-hole 221*c*.

The sixth nozzle 76 is supported toward the reflecting surface of the reflector 62 of the upper thread detector 60 at a tip thereof, and removes dust sticking to the reflecting surface of the reflector 62.

[Control System of Sewing Machine]

Figure 8:
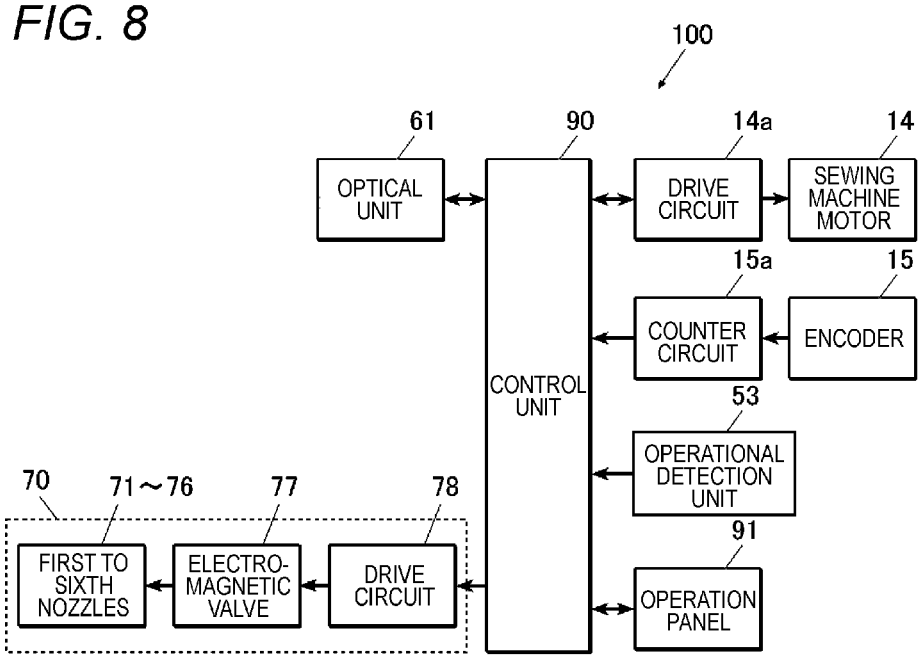
FIG. 8 is a block diagram illustrating a control system of the sewing machine.

As illustrated in FIG. 8, in the sewing machine 10, a drive circuit 14*a* for driving the sewing machine motor 14, a counter circuit 15*a* for a detected signal of an encoder 15 detecting an upper shaft angle, the operation detector 53, the optical unit 61 of the upper thread detector 60, a drive circuit 78 of an electromagnetic valve 77 controlling blowing operation of air of the air discharge mechanism 70, and an operation panel 91 that inputs start or setting information of needlework and displays given information are connected via interfaces (not illustrated).

The encoder 15 outputs two types of phase signals indicating the upper shaft angle. An encoder A-phase signal output from the encoder 15 is a minimum unit signal, and outputs one pulse whenever the upper shaft angle is changed by an angle of 1°. An encoder Z-phase signal output from the encoder 15 is a pulse signal that uses one rotation of the upper shaft as one cycle.

The control unit 90 can recognize the upper shaft angle by counting the number of pulses of the encoder A-phase signal using the encoder Z-phase signal as a starting point.

The control unit 90 is a microprocessor that is provided with programs for executing various processes and controls, and a memory (not illustrated) in which data used by the programs is stored and performs the various controls based on these programs.

The control unit 90 executes the programs, and thereby performs a needlework start determining process, a stitch skipping detecting process, and cleaning control.

In the needlework start determining process, when the start of needlework is input from the operation panel 91, it is detected by the operation detector 53 whether the input lever 52 is present, and the control unit 90 starts the needlework by driving the sewing machine motor 14 only when the approach of the input lever 52 is detected.

That is, when the input lever 52 is not detected by the operation detector 53, since there is a possibility that the presser frame 30 is not situated at a usable position and the middle shuttle presser 22 does not press the middle shuttle 23, driving of the sewing machine motor 14 is regulated for its own sake.

When the input lever 52 is detected by the operation detector 53, since this means that the presser frame 30 still presses the middle shuttle presser 22 from the front at a usable position, a needlework allowable state is set, and the needlework caused by driving the sewing machine motor 14 is initiated.

The stitch skipping detecting process is a process of detecting generation of stitch skipping using the upper thread detector 60 during needlework, and is repetitively performed in a given cycle during needlework.

That is, as described above, the upper thread detector 60 can detect the upper thread adequately passes through the lower portion of the bobbin case 24 due to a reduction in intensity of received light of the detecting light caused by the optical unit 61. Since a timing at which the upper thread passes through the lower portion of the bobbin case 24 is an nearly constant upper shaft angle, the control unit 90 monitors output of the encoder 15, and determines whether to detect the reduction in intensity of received light of the detecting light caused by the optical unit 61 within a given upper shaft angle range including the upper shaft angle in question. Thereby, if the reduction in intensity of received light does not occur, the upper thread does not pass through the bobbin case 24, and thus it can be detected that the stitch skipping is generated.

Therefore, the control unit 90 functions as "a stitch skipping detection processor for determining whether the passage of the upper thread is present based on an amount of received light of the detecting light caused by the upper thread detector."

The cleaning control is control of performing blowing of air from the first to sixth nozzles 71 to 76 of the air discharge mechanism 70 during needlework and removal of dust at each position on the optical path of the detecting light.

In the cleaning control, when the completion of the needlework is detected by, for example, input of fulfillment of thread cutting from the operation panel 91 in principle, the control unit 90 opens the electromagnetic valve 77 to perform the blowing of air from each of the nozzles 71 to 76 for a given time.

However, in the case of the sewing machine 10, when a needle location frequency according to the needlework exceeds 1000 times, an amount of sticking dust around the vertical half-turn shuttle 20 increases, and a reduction in detection accuracy of the upper thread by the optical unit 61 of the upper thread detector 60 occurs.

Thus, in addition to when the needlework is completed, the control unit 90 opens the electromagnetic valve 77 to perform the control of blowing air from each of the nozzles 71 to 76 for a given time at intervals of 500 rotations of the upper shaft from the start of the needlework. The number of rotations of the upper shaft is detected by the encoder 15.

Thereby, the control unit 90 functions as "a cleaning control unit for controlling the air discharge mechanism to periodically perform the blowing of air at intervals of a specified needle location frequency or a specified time." A blowing interval of air can be freely changed by a user, and thus blowing at intervals of a given time can also be changed.

[Needlework Operation]

Figure 9:
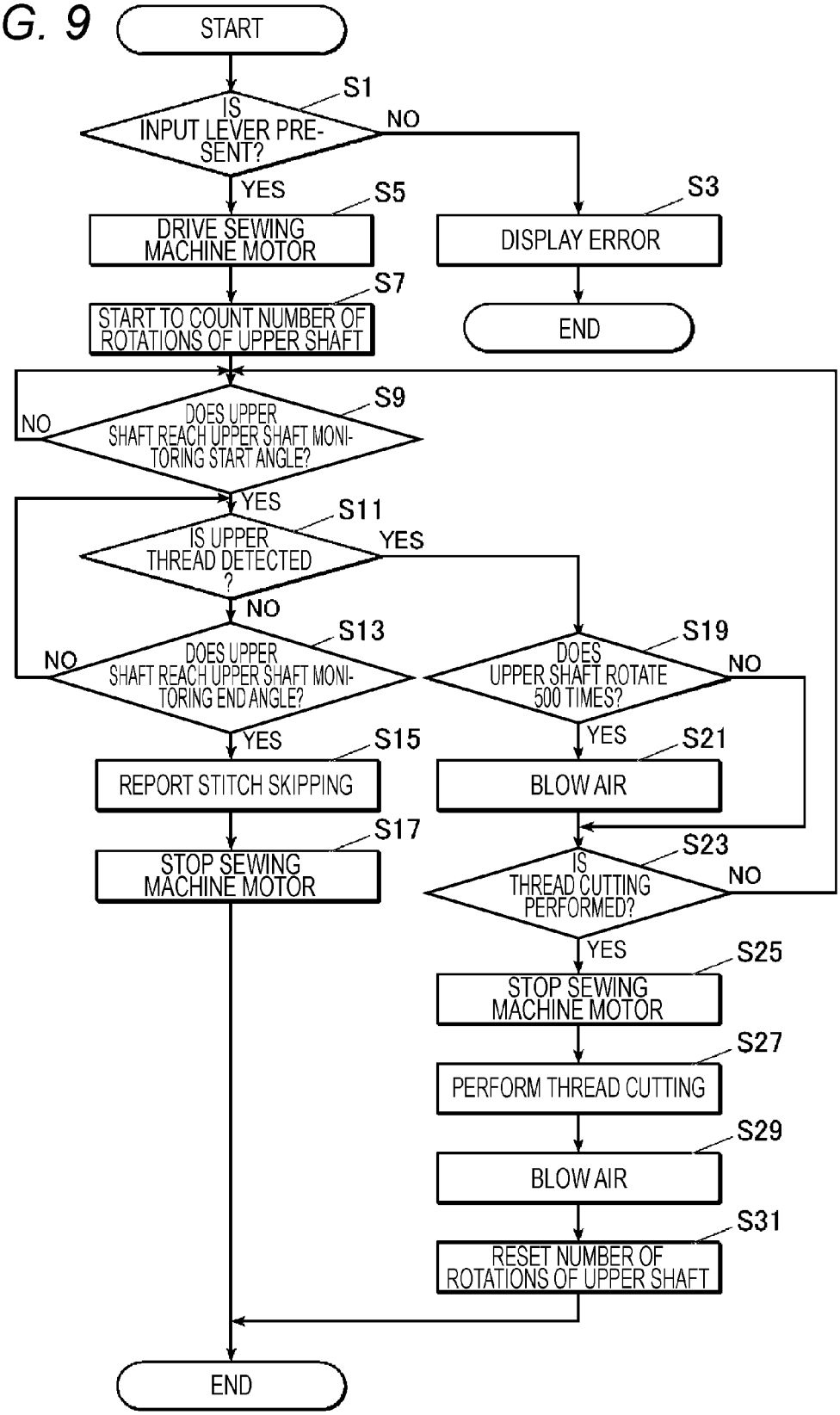
FIG. 9 is a flow chart illustrating needlework control depending on a control unit.

Needlework operation control including the needlework start determining process, the stitch skipping detecting process, and the cleaning control which the control unit 90 performs will be described based on a flow chart of FIG. 9.

First, when the start of needlework is input from the operation panel 91, the control unit 90 determines using the operation detector 53 whether the input lever 52 of the toggle mechanism 50 is situated at an operating position as a pressing position in which the presser frame 30 is pressed (step S1).

Thereby, when it is detected by the operation detector 53 that the input lever 52 is not situated at the operating position (NO of step S1), an error informing pressing omission is displayed on the operation panel 91 as an error that the pressing omission of the middle shuttle presser 22 caused by the presser frame 30 occurs (step S3).

On the other hand, when it is detected by the operation detector 53 that the input lever 52 is situated at the operating position (YES of step S1), the control unit 90 starts driving the sewing machine motor 14 (step S5), and starts counting the number of rotations of the upper shaft from the Z-phase signal of the encoder 15 (step S7).

Further, the control unit 90 determines, from the A-phase signal of the encoder 15, whether the upper shaft reaches an upper shaft monitoring start angle that is a start angle of the angle range of the upper shaft for detecting that the upper thread caught by the middle shuttle 23 properly passes through the lower portion of the bobbin case 24 (step S9).

When the upper shaft does not reach the upper shaft monitoring start angle (NO of step S9), the determination is repetitively performed. When the upper shaft reaches the upper shaft monitoring start angle (YES of step S9), the control unit 90 determines, from the output of the light-receiving element of the optical unit 61, whether a reduction in intensity of received light according to the passage of the upper thread is detected (step S11).

When the upper thread is not detected (NO of step S11), the control unit 90 determines, from the A-phase signal of the encoder 15, whether the upper shaft reaches an upper shaft monitoring end angle that is an end angle of the angle range of the upper shaft for detecting that the upper thread caught by the middle shuttle 23 properly passes through the lower portion of the bobbin case 24 (step S13).

When the upper shaft does not reach the upper shaft monitoring end angle (NO of step S13), the control unit 90 returns the process, and again determines, from the output of the light-receiving element of the optical unit 61, whether a reduction in intensity of received light according to the passage of the upper thread is detected (step S11).

In contrast, when the passage of the upper thread is not detected and thus the upper shaft reaches the upper shaft monitoring end angle (YES of step S13), it is determined that the stitch skipping is generated, and the control unit 90 informs the operation panel 91 of the generation of the stitch skipping (step S15), stops the sewing machine motor 14 (step S17), and completes the needlework operation control.

On the other hand, in step S11, when the passage of the upper thread is detected (YES of step S11), the control unit 90 determines whether a value obtained by counting the number of rotations of the upper shaft using the encoder 15 reaches 500 rotations (step S19).

When the value obtained by counting the number of rotations of the upper shaft does not reach 500 rotations (NO of step S19), the process proceeds to step S23. When the value obtained by counting the number of rotations of the upper shaft reaches 500 rotations (YES of step S19), the control unit 90 opens the electromagnetic valve 77 of the air discharge mechanism 70 to continue to perform the blowing of air from each of the nozzles 71 to 76 for a given time (step S21).

Next, the control unit 90 determines whether fulfillment of thread cutting is input from the operation panel 91 (step S23). When the fulfillment of thread cutting is not input (NO of step S23), the control unit 90 returns the process to step S9, and determines whether the upper shaft angle reaches the upper shaft monitoring start angle.

When the fulfillment of thread cutting is input (YES of step S23), the control unit 90 stops driving the sewing machine motor 14 (step S25), and the thread cutting is fulfilled by the thread cutting device (step S27).

The control unit 90 opens the electromagnetic valve 77 of the air discharge mechanism 70 to continue to perform the blowing of air from each of the nozzles 71 to 76 for a given time (step S29), resets the value obtained by counting the number of rotations of the upper shaft (step S31), and completes the needlework operation control.

[Technical Effects of the Embodiment of the Invention]

The above sewing machine 10 is provided with the optical upper thread detector 60 that is equipped for the presser frame 30 pressing the middle shuttle presser 22 and detects the passage of the upper thread by means of the detecting light which passes through the through-holes 221*b* and 221*c* of the middle shuttle presser 22 and crosses the front side of the bobbin case 24 of the vertical half-turn shuttle 20, and the control unit 90 acting as the stitch skipping detection processor that determines whether the passage of the upper thread is present based on the amount of received light of the detecting light caused by the upper thread detector 60.

For this reason, because of the through-holes 221*b* and 221*c* formed in the middle shuttle presser 22, the upper thread can be detected by the detecting light crossing the front side of the bobbin case 24, and the detecting light is not projected to the front of the bobbin case 24. Thus, a variation in reflected light depending on vibration can be inhibited, and an influence of disturbance can be reduced. Thus, the passage of the upper thread can be accurately detected, and the generation of the stitch skipping can also be accurately detected.

Since the upper thread detector 60 is mounted on the presser frame 30, the upper thread detector 60 can be retracted along with the presser frame 30 in the event of maintenance or exchange, cleaning work, etc. of the shuttle, while easily securing an installation space around the vertical half-turn shuttle 20, and workability can be improved.

Since the pins 223 and 223 and the positioning holes 321 and 321 are provided between the presser frame 30 and the middle shuttle presser 23 to serve as uneven structures for performing the positioning, relative position between the presser frame 30 and the middle shuttle presser 23 can be easily performed due to simple structures. As a result, since the upper thread detector 60 can also be accurately positioned for the vertical half-turn shuttle 20, the passage of the upper thread can be accurately detected.

Since a part of the through-hole 221*b* formed in the circumferential wall portion 221 of the middle shuttle presser 23 has a shape (an approximate fan shape) taking the concave shape of the concave portion 247 formed in the front of the vertical half-turn shuttle 20, the variation of the intensity of received light of the detecting light can be reduced even when the bobbin case 24 vibrates forward and backward, and the passage of the upper thread can be more accurately detected even when vibration occurs at the vertical half-turn shuttle 20.

Due to the configuration in which the presser frame 30 can be rotated between the pressing position and the retract position by the frame support mechanism 40 and the toggle mechanism 50 for giving the pressing pressure toward the middle shuttle presser 23 to the presser frame 30 situated at the pressing position is provided, the presser frame 30 can be firmly fixed to the middle shuttle presser 23, and the upper thread detector 60 can also firmly supported.

If necessary, the pressed state caused by the presser frame 30 can also be easily released.

Since the toggle mechanism 50 has the operation detector 53 detecting the operation state of the input lever 52, the pressing omission caused by the presser frame 30 can be detected during needlework, and the needlework performed when the middle shuttle presser 23 is not pressed by the presser frame 30 can be prevented and reduced.

Since the sewing machine 10 has the air discharge mechanism 70 that performs the air blowing for removing dust on the passing path of the detecting light, the dust can be removed from each portion on the passing path of the detecting light, for example the through-holes 221*b* and 221*c* of the middle shuttle presser 22, the optical unit 61 and the reflector 62 of the upper thread detector 60, or the like, and the influence of the dust can be reduced to detect the passage of the upper thread with higher accuracy.

Since the control unit 90 controls the air discharge mechanism 70 to perform the air blowing caused by the air discharge mechanism 70 at intervals of the specified needle location frequency (for example, 500 times), the air blowing can be performed at a sufficient and proper frequency before a reduction in detection accuracy occurs.

[Others]

The case in which the sewing machine 10 has the vertical half-turn shuttle 20 is given as an example, but a vertical full-turn shuttle may be provided.

The number of rotations of the upper shaft performing the air blowing caused by the air discharge mechanism 70 under the cleaning control is not limited to 500 times. Moreover, the number of rotations of the upper shaft may be arbitrarily set by setting means such as the operation panel 91.

What is claimed is:

1. A sewing machine having a vertical shuttle and a middle shuttle presser disposed at a front side of the vertical shuttle, the sewing machine comprising:

a presser frame that is disposed between a pressing position at which the middle shuttle presser is pressed and a retract position separated from the pressing position;

an optical upper thread detector that is provided at the presser frame, the optical upper thread detector comprising a sensor that detects light that passes through through-holes in the middle shuttle presser and crosses a front side of a bobbin case of the vertical shuttle, wherein passage of an upper thread is determined by detection of light by the optical upper thread detector; and a stitch skipping detection processor that is configured to determine whether the passage of the upper thread is present based on an amount of received light of the detecting light from the upper thread detector.

2. The sewing machine according to claim 1, wherein an uneven structure for positioning is provided between the presser frame and the middle shuttle presser.

3. The sewing machine according to claim 2, wherein the uneven structure includes a pin and a hole which allows the pin to insert in the hole.

4. The sewing machine according to claim 1, wherein the middle shuttle presser has a circumferential wall portion surrounding a periphery of the vertical shuttle;

through-holes are formed in the circumferential wall portion acting as the passage portions; and a part of each through-hole has a shape configured to fit a recess shape of a concave portion formed in a front of the vertical shuttle.

5. The sewing machine according to claim 1, further comprising:

a toggle mechanism comprising an input lever and a link body, the toggle mechanism being configured to apply a pressing pressure to the presser frame at the pressing position toward the middle shuttle presser, wherein when the input lever is rotated, the presser frame is rotated to move between the pressing position and the retract position.

6. The sewing machine according to claim 5, wherein the toggle mechanism includes:

an operation detector which is configured to detect an operation state of the input lever; and wherein the input lever is configured to apply and release the pressing pressure to and from the pressing frame.

7. The sewing machine according to claim 1, further comprising:

an air discharge mechanism that is configured to blow air for removing dust on a passing path of the detecting light.

8. The sewing machine according to claim 7, wherein the air discharge mechanism is provided at the presser frame, and has nozzles which blow air on the passage portions of the middle shuttle presser from one end portion and the other end portion of the middle shuttle presser in a passing direction.

9. The sewing machine according to claim 7, wherein the air discharge mechanism is provided at the presser frame, and has nozzles which blow air on light-receiving and light-emitting portions of the upper thread detector.

10. The sewing machine according to claim 7, further comprising:

a cleaning control unit that is configured to control the air discharge mechanism to periodically blow air at intervals of a predetermined number of stitching or at a predetermined timing.

* * * * *